US005361652A

United States Patent [19]

Andina

[11] Patent Number: 5,361,652

[45] Date of Patent: Nov. 8, 1994

[54] CORKSCREW

[76] Inventor: Diego Andina, Via Sale, 25064 Gussago Brescia, Italy

[21] Appl. No.: 81,880

[22] Filed: Jun. 25, 1993

[30] Foreign Application Priority Data

Feb. 2, 1993 [IT] Italy ..... MI93 U 000077

[51] Int. Cl.[5] ..... B67B 7/18

[52] U.S. Cl. ..... 81/3.29; 81/3.48

[58] Field of Search ..... 81/3.29, 3.37, 3.48, 81/3.49

[56] References Cited

U.S. PATENT DOCUMENTS 4,135,415 1/1979 Liebscher et al. ..... 81/3.29

4,570,512 2/1986 Pracht ..... 81/3.29

4,658,678 4/1987 Pracht ..... 81/3.29

*Primary Examiner*—James G. Smith

*Attorney, Agent, or Firm*—Guido Modiano; Albert Josif; Daniel O'Byrne

[57] ABSTRACT

The corkscrew has a Teflon-coated worm and a body, which can be associated with the neck of a bottle and rotatably and slidably supports, in an upward region, the Teflon-coated worm, which is connected to an actuation butterfly. The corkscrew also has a guiding slider which slidably engages the body and defines a guiding hole which engages and axially positions the worth to position it axially.

11 Claims, 3 Drawing Sheets

CORKSCREW

BACKGROUND OF THE INVENTION

The present invention relates to a corkscrew.

As known, various kinds of corkscrew are commercially available and are based on the most disparate operating principles. Among these, there are corkscrews having a worm coated with polytetrafluoroethylene, commonly known by the registered trademark "Teflon". Such corkscrews are constituted by a body which couples to the neck of the bottle at its lower end, and rotatably and slidably supports, in an upward region, a worm the surface of which is coated with Teflon. During an initial rotation step the Teflon-coated worm penetrates the cork by means of a translatory motion with respect to the body until, once the possibility of axial sliding with respect to the body ends, subsequent rotation causes a translatory motion of the cork, consequently extracting it from the neck of the bottle.

This kind of corkscrew works well only if the worm penetrates in a perfectly axial direction with respect to the cork, since penetration in an eccentric position or with an inclined arrangement produces components which break the cork without extracting it.

At the present time this problem has not been solved, and the satisfactory operation of this type of corkscrew is in practice entrusted to the skill and care of the user, who must insert the worm in a perfectly axial direction without creating forcing actions which might then cause the worm to tilt.

SUMMARY OF THE INVENTION

An aim of the present invention is to solve the problem described above by providing a corkscrew having a Teflon-coated worm, wherein it is possible to guide the insertion of the worm perfectly in an axial direction, without having to resort to particular contrivances and without requiring particular skill on the part of the user.

Within the scope of the above aim, a particular object of the present invention is to provide a corkscrew which allows to always achieve rapid and easy extraction of the cork, since the worm is always inserted in a perfectly axial direction with respect to the cork.

Another object of the present invention is to provide a corkscrew with a Teflon-coated worm which, by virtue of its peculiar constructive characteristics, is capable of giving the greatest assurances of reliability and safety in use.

Another object of the present invention is to provide a corkscrew with a Teflon-coated worm which can be easily obtained starting from commonly commercially available elements and materials and is furthermore competitive from a merely economical point of view.

This aim, these objects and others which will become apparent hereinafter are achieved by a corkscrew with Teflon-coated worm according to the invention, comprising a body which can be associated, in a downward region, with the neck of a bottle and rotatably and slidably supports, in an upward region, a Teflon-coated worm connected to an actuation butterfly; characterized in that it comprises a guiding slider which slidably engages said body and defines a guiding hole which engages said worm to position said worm axially.

BRIEF DESCRIPTION OF THE DRAWINGS

Further characteristics and advantages of the present invention will become apparent from the detailed description of a corkscrew with Teflon-coated worm, illustrated only by way of non-limitative example in the accompanying drawings, wherein.

DESCRIPTION OF THE PREFERRED EMBODIMENTS

Figures 1, 7, 9, 10, 11:
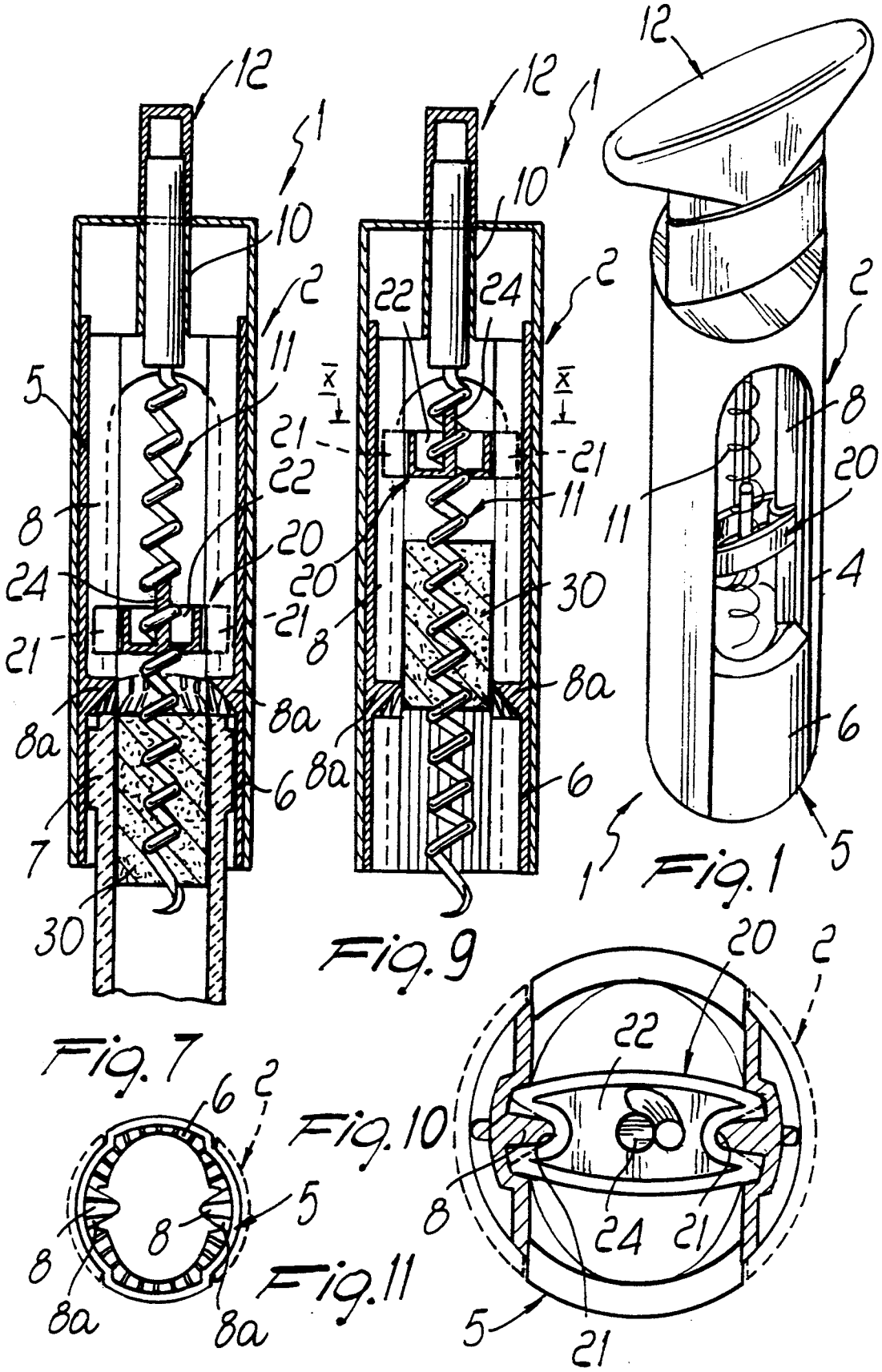
FIG. 1 is a schematic perspective view of the corkscrew according to the present invention.
FIG. 7 is a sectional view, taken along a plane at right angles with respect to the plane of FIG. 6, of the corkscrew during the insertion of the worm in the cork.
FIG. 9 is a sectional view of the corkscrew with the cork fully extracted.
FIG. 10 is a sectional view, taken along the plane 10—10 of FIG. 9.
FIG. 11 is a bottom plan view of the core located inside the external shell of the corkscrew body.
Figure 2:
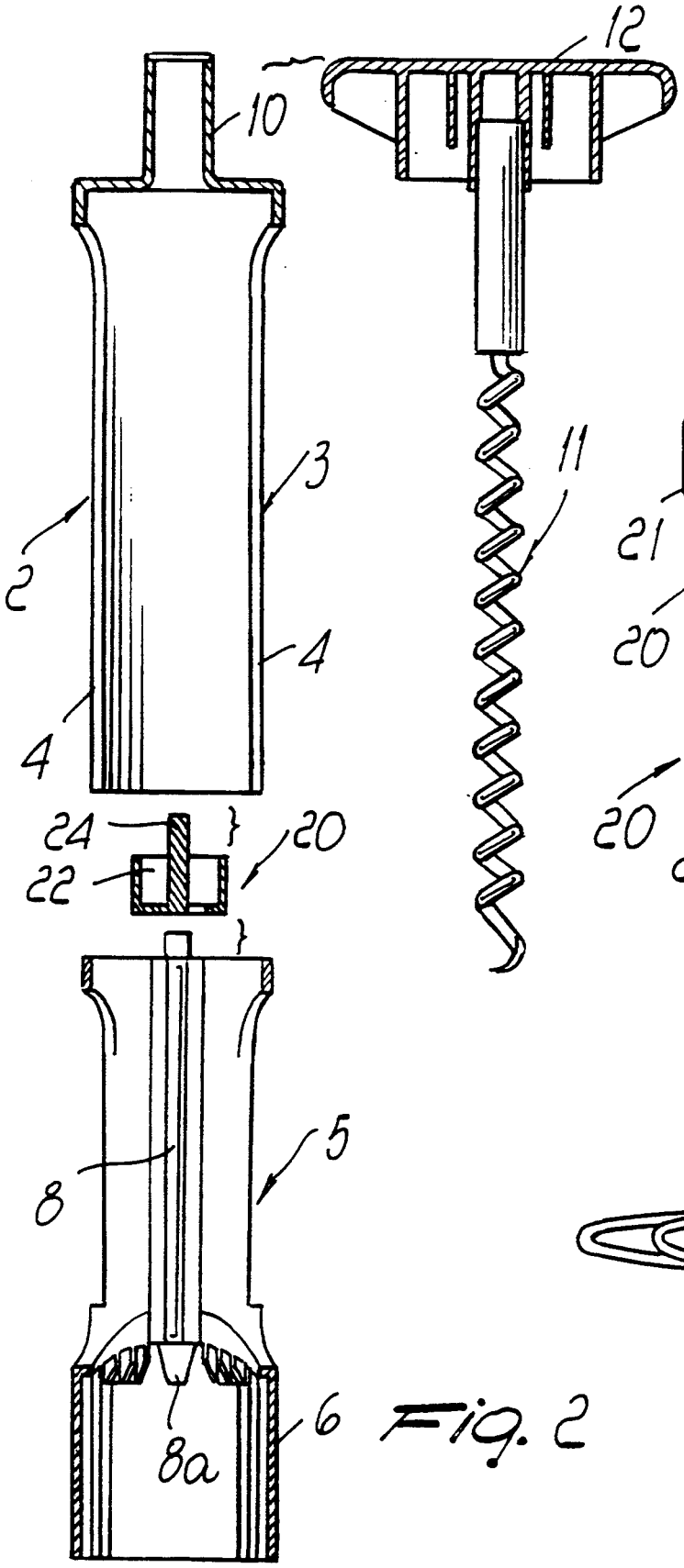
FIG. 2 is a sectional exploded view of the corkscrew.
Figure 3:
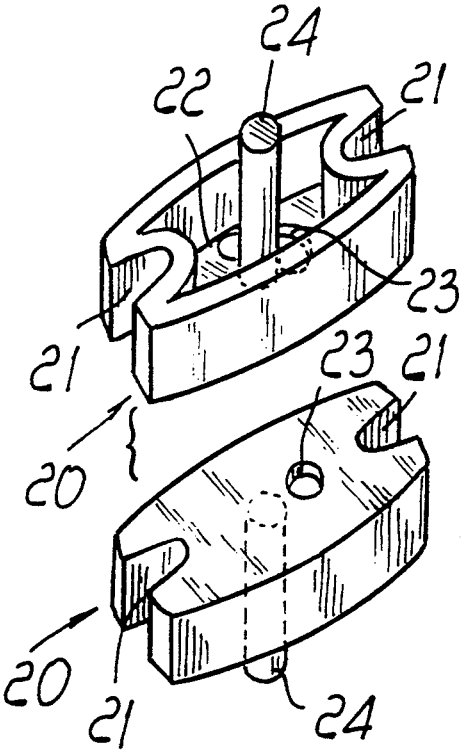
FIG. 3 is a perspective view of the guiding slider, seen from its lower face and from its upper face.
Figure 4:
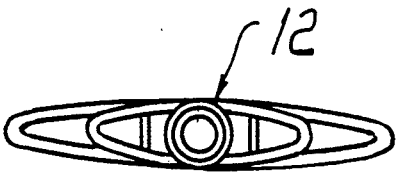
FIG. 4 is a schematic view of the actuation butterfly, seen from its lower end.

With reference to the above figures, the corkscrew with Teflon-coated worm, according to the present invention, generally designated by the reference numeral 1, comprises a body 2 having a cylindrical outer shell 3 with large diametrical openings 4, and a core, preferably made of plastic material and generally designated by the reference numeral 5. The core 5 is provided inside said shell 3 and defines the lower part 6, which engages the neck 7 of the bottle, and a pair of guiding uprights 8 extend mutually opposite along a vertical direction.

At the upper part, the outer shell 3 defines a guiding inlet 10 in which a Teflon-coated helical screw or worm, designated by the reference numeral 11, is slidably and rotatably accommodated; outside the body 2, said worm is connected to an actuation butterfly or handle designated by the reference numeral 12.

The peculiarity of the present invention resides in the fact that it comprises a guiding slider, generally designated by the reference numeral 20 having a substantially oblong configuration in plan view. The guiding slider 20 has engagement means, constituted by opposite recesses 21 for sliding engagement with the uprights 8 of the body which allow it to slide in an axial direction with respect to the corkscrew.

On the bottom 22 of the slider 20 there is a guiding hole 23, in which the worm 11 is insertable, and there is also an axial pin 24 which is inserted within the surface delimited by the cylindrical worm. As clearly shown in FIGS. 5–9, the axial pin 24 is surrounded by a portion of the helical screw 11. As clearly shown in FIG. 10, the guiding hole 23, penetrated by the helical screw 11, is formed in the guiding slider 20 at a location which is eccentric with respect to the axial pin 24.

The slider thus has the purpose of centering the worm perfectly in an axial direction, causing cork perforation to occur in such a manner that said worm is in a perfectly centered and axial position and furthermore preventing the worm from tilting due to stresses or forcing, since said worm is axially guided and retained by the axial pin 24.

Figures 5, 6, 8:
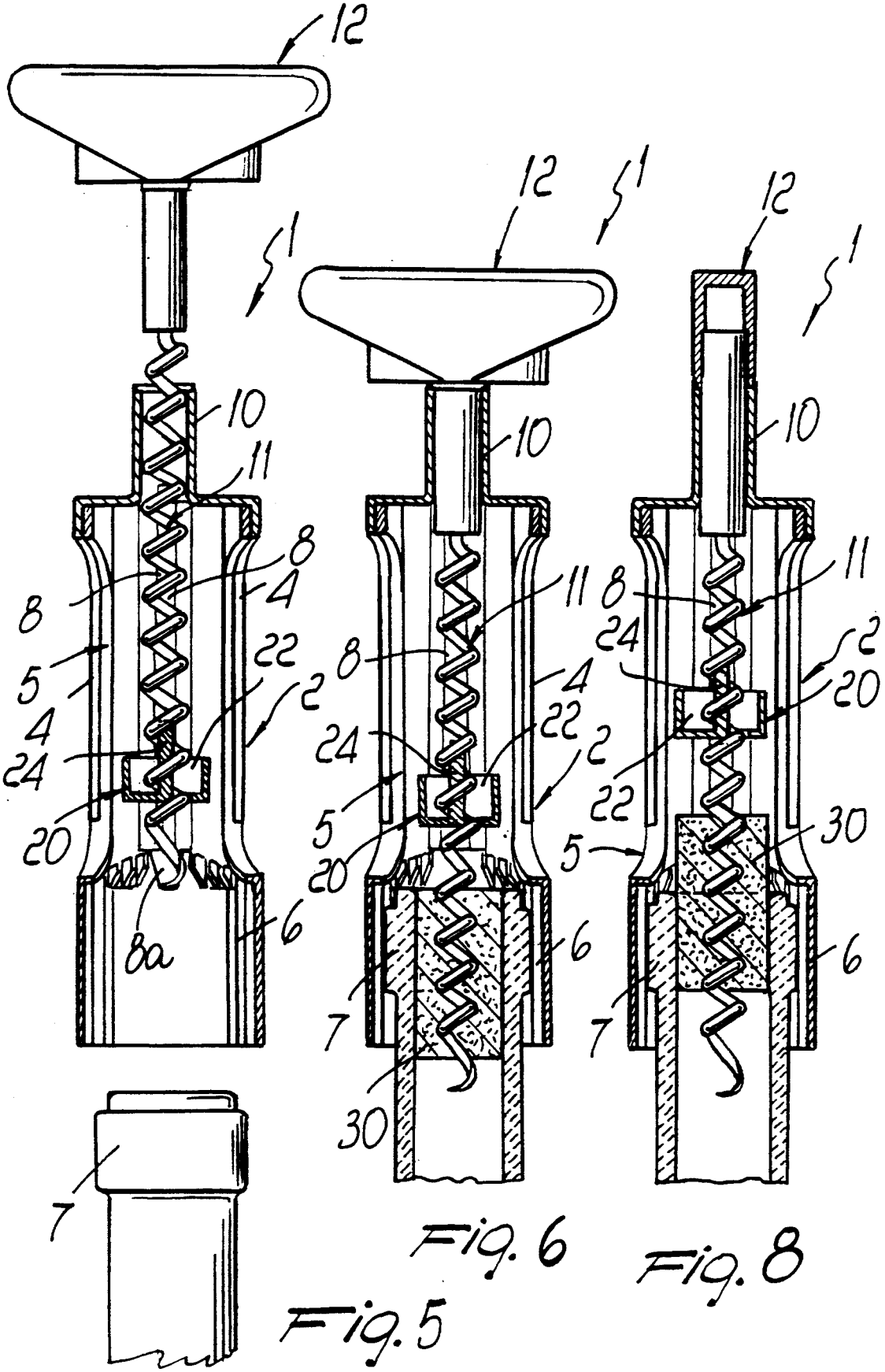
FIG. 5 is a schematic view of the corkscrew prior to its application on the neck of the bottle.
FIG. 6 is a schematic sectional view of the insertion of the Teflon-coated worm in the cork.
FIG. 8 is a sectional view of the protrusion of the cork from the neck of the bottle.

As shown in FIG. 5, during the initial insertion step, the guiding slider is located in a downward region and is retained by expansions 8*a* provided at the lower end of the uprights 8.

In this position, the worm can be inserted into a cork 30 to be extracted from a bottle 7. By rotating the handle 12, the worm penetrates the cork until the actuation butterfly engages the guiding inlet 10.

By continuing the rotation of the handle 12 and consequently of the Teflon-coated worm 11, since the translatory motion of the worm inside the cork cannot continue, the cork 30 itself moves with respect to the worm 11 and, due to the component of the stresses, the cork 30 is extracted from the bottle 7. The cork 30 protrudes and engages between the uprights 8, which in addition to acting as guiding elements for the sliding movement of the slider 20 also have the purpose of diametrically engaging the cork 30, preventing its rotation.

From what has been described above it can thus be seen that the present invention achieves the intended aim and objects, and in particular the fact is stressed that the presence of the slider 20, provided with the guiding hole 23, ensures that the worm is always arranged axially with respect to the cork and thus penetrates the cork along a direction which is perfectly axial and arranged concentrically with respect to the cork axis.

In these conditions, cork extraction assuredly occurs without the possibility of cork breakage, since said cork in practice slides along the worm and rises toward the outside of the neck of the bottle.

In practice, the materials employed, although the best results have been achieved by using the described materials, as well as the contingent shapes and dimensions, may be any according to the requirements.

What is claimed is:

1. Corkscrew comprising a body (2–5) having a cylindrical outer shell (3), an end part (6) defined by said body (2–5) for engagement with a bottle neck (7), a guiding inlet (10) defined by said outer shell (3) opposite said end part (6), guide means (8) located within said outer shell (3) and extending longitudinally between said guiding inlet (10) and said end part (6), a helical screw (11) extending through said guiding inlet (10) and into said outer shell (3) parallel to said guide means (8), a handle (12) connected to said helical screw (11) and located externally of said guiding inlet (10), a guiding slider (20) located within said outer shell (3), engagement means (21) located peripherally on said guiding slider (20) and slideably engaging said guide means (8), an axial pin (24) provided centrally on said guiding slider (20) and being surrounded by a portion of said helical screw (11), and a guiding hole (23) provided eccentrically on said guiding slider (20) with respect to said axial pin (24) and being penetrated by said helical screw (11).

2. Corkscrew according to claim 1, wherein said guide means (8) comprise at least two guiding uprights (8), and wherein said engagement means (21) comprise at least two mutually opposite recesses (21) formed in said guiding slider (20) and slideably engaging said guiding uprights (8).

3. Corkscrew according to claim 2, wherein said guiding uprights (8) are formed on a core (5), said core (5) being at least partially accommodated within said outer shell (3) and defining said end part (6).

4. Corkscrew according to claim 1, wherein said helical screw is coated with polytetrafluoroethylene.

5. Corkscrew according to claim 1, further comprising expansions (8*a*) connected to said guiding uprights (8) for retaining said guiding slider (20) on said helical screw (11) in said outer shell (3).

6. Corkscrew according to claim 1, further comprising at least two diametrically aligned openings (4) extending longitudinally along said outer shell between said guiding inlet (10) and said end part (6).

7. Corkscrew comprising a body (2–5) having a cylindrical outer shell (3), a core (5) at least partially accommodated within said outer shell (3), an end part (6) defined by said core (5) for engagement with a bottle neck (7), a guiding inlet (10) defined by said outer shell (3) opposite said end part (6), at least two guiding uprights (8) formed on said core (5) and located within said outer shell (3), said guiding uprights (8) extending longitudinally between said guiding inlet (10) and said end part (6), a helical screw (11) extending through said guiding inlet (10) and into said outer shell (3) parallel to said guiding uprights (8), a handle (12) connected to said helical screw (11) and located externally of said guiding inlet (10), a guiding slider (20) located within said outer shell (3), at least one pair of mutually opposite engagement recesses (21) formed on said guiding slider (20) and slideably engaging said guiding uprights (8), an axial pin (24) provided centrally on said guiding slider (20) and being surrounded by a portion of said helical screw (11), and a guiding hole (23) provided eccentrically on said guiding slider (20) with respect to said axial pin (24) and being penetrated by said helical screw (11).

8. Corkscrew according to claim 7, wherein said helical screw is coated with polytetrafluoroethylene.

9. Corkscrew according to claim 7, further comprising expansions (8*a*) connected to said guiding uprights (8) for retaining said guiding slider (20) on said helical screw (11) in said outer shell (3).

10. Corkscrew according to claim 7, further comprising at least two diametrically aligned openings (4) extending longitudinally along said outer shell between said guiding inlet (10) and said end part (6).

11. Corkscrew comprising a body (2–5) having a cylindrical outer shell (3), a core (5) at least partially accommodated within said outer shell (3), an end part (6) defined by said core (5) for engagement with a bottle neck (7), a guiding inlet (10) defined by said outer shell (3) opposite said end part (6), diametrically aligned openings (4) extending longitudinally along said outer shell between said guiding inlet (10) and said end part (6), at least two guiding uprights (8) formed on said core (5) and located within said outer shell (3), said guiding uprights (8) extending longitudinally between said guiding inlet (10) and said end part (6), a helical screw (11) coated with polytetrafluoroethylene, said helical screw (11) extending through said guiding inlet (10) and into said outer shell (3) parallel to said guiding uprights (8) and said diametrically aligned openings (4), a handle (12) connected to said helical screw (11) and located externally of said guiding inlet (10), a guiding slider (20) located within said outer shell (3), at least one pair of mutually opposite engagement recesses (21) formed on said guiding slider (20) and slideably engaging said guiding uprights (8), an axial pin (24) provided centrally on said guiding slider (20) and being surrounded by a portion of said helical screw (11), a guiding hole (23) provided eccentrically on said guiding slider (20) with respect to said axial pin (24) and being penetrated by said helical screw (11), and expansions (8*a*) connected to said guiding uprights (8) for retaining said guiding slider (20) on said helical screw (11) in said outer shell (3).

* * * * *